US005713419A

United States Patent [19]

Kaczmarski et al.

[11] Patent Number: 5,713,419

[45] Date of Patent: Feb. 3, 1998

[54] INTELLIGENT ATTACHMENT TO A POWER TOOL

[75] Inventors: Wally L. Kaczmarski, Lisbon; Scott B. Jacobson, Kindred; Verne C. Watts, Lisbon, all of N. Dak.

[73] Assignee: Clark Equipment Company, Woodcliff Lake, N.J.

[21] Appl. No.: 655,749

[22] Filed: May 30, 1996

[51] Int. Cl.[6] ..... B66F 9/06; A01G 23/04

[52] U.S. Cl. ..... 172/2; 172/4.5; 111/101; 37/302

[58] Field of Search ..... 37/302, 900, 902; 111/101, 102; 172/4.5, 2, 5, 7; 414/21, 217, 525, 699; 364/424.07

[56] References Cited

U.S. PATENT DOCUMENTS

| | | | |
|---|---|---|---|
| 3,936,960 | 2/1976 | Clegg | 111/101 |
| 4,199,033 | 4/1980 | Van Gundy, Jr. | 173/27 |
| 4,222,186 | 9/1980 | Molby | 37/86 |
| 4,403,427 | 9/1983 | Dahlquist | 111/101 |
| 4,620,362 | 11/1986 | Reynolds | 29/568 |
| 4,850,766 | 7/1989 | Furuhashi et al. | 409/234 |
| 4,934,463 | 6/1990 | Ishida et al. | 172/4.5 |
| 4,957,408 | 9/1990 | Ohkura | 414/635 |
| 4,964,779 | 10/1990 | Sagaser | 414/708 |
| 5,065,326 | 11/1991 | Sahm | 354/424.07 |
| 5,081,941 | 1/1992 | Weeks | 37/302 X |
| 5,188,502 | 2/1993 | Tonsor et al. | 414/700 |
| 5,249,140 | 9/1993 | Kessler | 364/551.01 |
| 5,257,177 | 10/1993 | Bach et al. | 364/167.01 |
| 5,347,448 | 9/1994 | Nam | 364/167.01 |
| 5,398,766 | 3/1995 | Nakayama et al. | 172/4.5 |
| 5,425,431 | 6/1995 | Brandt et al. | 180/273 |
| 5,459,952 | 10/1995 | Tillaart et al. | 111/101 X |

*Primary Examiner*—Terry Lee Melius
*Assistant Examiner*—Robert Pezzuto
*Attorney, Agent, or Firm*—Westman, Champlin & Kelly, P.A.

[57] ABSTRACT

A power attachment is attachable to a power machine which has a power circuit. The power machine also includes an operator input device receiving an operator input and providing an output signal indicative of the operator input. The attachment includes a tool and an actuator, coupled to the tool, to drive the tool. The actuator is also connectable to the power circuit of the power machine. A controller is operably coupled to the actuator and is operably coupleable to the operator input device. The controller controls operation of the tool based on an operator input signal provided by the operator input device.

21 Claims, 5 Drawing Sheets

68
CONTROLLER
TO FLOW CONTROL APPARATUS
ROD
TO LOADER 10
POWER TO LOADER 10
SPADE 1
SPADE 2
SPADE 3
LED
91
CONTROLLER
82
GATE CLOSE
GATE OPEN
SUPPLY TO REST OF CKT.
REGULATOR
83
BATTERY
GROUND
FILTER
81
CCW
GATE OPEN
GATE CLOSE
FROM LOADER 10 VIA 70
50
52
48
66
64
84
86
88
90
92
94
96
T
P
S1
S2
FROM
62

INTELLIGENT ATTACHMENT TO A POWER TOOL

INCORPORATION BY REFERENCE

U.S. patent application, Ser. No. 08/435,601, filed May 5, 1995, entitled HYDRAULIC CONTROL SYSTEM PROVIDING PROPORTIONAL MOVEMENT TO AN ATTACHMENT TO THE POWER MACHINE. U.S. patent application, Ser. No. 08/199,120, filed Feb. 22, 1994, entitled HYDRAULIC INTERLOCK SYSTEM. U.S. Pat. No. 5,425,431 issued Jun. 20, 1995, to Brandt et al. entitled INTERLOCK CONTROL SYSTEM FOR POWER MACHINE. All the above references are assigned to the same assignee as the present application.

BACKGROUND OF THE INVENTION

The present invention deals with a power machine. More specifically, the present invention deals with a power machine having an attachment with a controller thereon for controlling the attachment.

Power machines, such as skid steer loaders, typically have a frame which supports a cab or an operator compartment and a movable lift arm which, in turn, supports a work tool such as a bucket, an auger, or a tree spade. The movable lift arm is pivotally coupled to the frame of the skid steer loader and is powered by power actuators which are commonly hydraulic cylinders. In addition, the tool is coupled to the lift arm and is powered by one or more additional power actuators which are also commonly hydraulic cylinders. An operator manipulating a skid steer loader raises and lowers the lift arm, and manipulates the tool, by actuating the hydraulic cylinders coupled to the lift arm, and the hydraulic cylinders coupled to the tool.

With a front attachment (or tool) such as a tree spade, which utilizes a plurality of hydraulic actuators, a number of valves must be added to the hydraulic system of the skid steer loader in order to control the flow of hydraulic fluid under pressure to the plurality of cylinders on the tree spade. In the past, the addition of these valves has required the addition of mounting hardware on the skid steer loader. For example, in some prior skid steer loaders, the valve bank used to control the hydraulic actuators on the tree spade were mounted on the doorway of the cab or operator compartment. This required the hydraulic fluid under pressure to be routed to that valve bank, and then out to the tree spade.

It is also common for control levers in skid steer loaders to have hand grips which support a plurality of buttons or actuable switches, actuable by the operator to perform certain functions. Depending on the particular type of attachment or attachments mounted on the skid steer loader, certain functions may be disabled or unusable. Further, depending on the particular type of attachment or attachments mounted on the skid steer loader, certain combinations of inputs from the operator input devices, when performed simultaneously, can result in a opposing control valves being opened. This essentially provides an equal amount of pressurized fluid to both sides of a hydraulic actuator or hydraulic motor.

SUMMARY OF THE INVENTION

An attachment is attachable to a power machine which has a power circuit and an operator input device receiving operator inputs and providing an output signal indicative of operator inputs. The attachment includes a tool, a power actuator (coupled to the tool to drive the tool and connectable to the power circuit of the power machine) and a controller. The controller is operably coupled to the power actuator and is also operably coupleable to the operator input device on the power machine. The controller controls operation of the tool based on the operator input.

In one preferred embodiment, the attachment comprises a tree transplanter with a plurality of spades (referred to in its entirety as to a tree spade). A plurality of hydraulic actuators are coupled to the spades and are also coupled to a hydraulic system on the skid steer loader which provides hydraulic fluid under pressure. A controller is operably coupled to the hydraulic actuators and is coupleable to the operator input device on the skid steer loader. The controller controls operation of the spades based on the operator inputs.

DETAILED DESCRIPTION OF THE PREFERRED EMBODIMENTS

Figure 1:
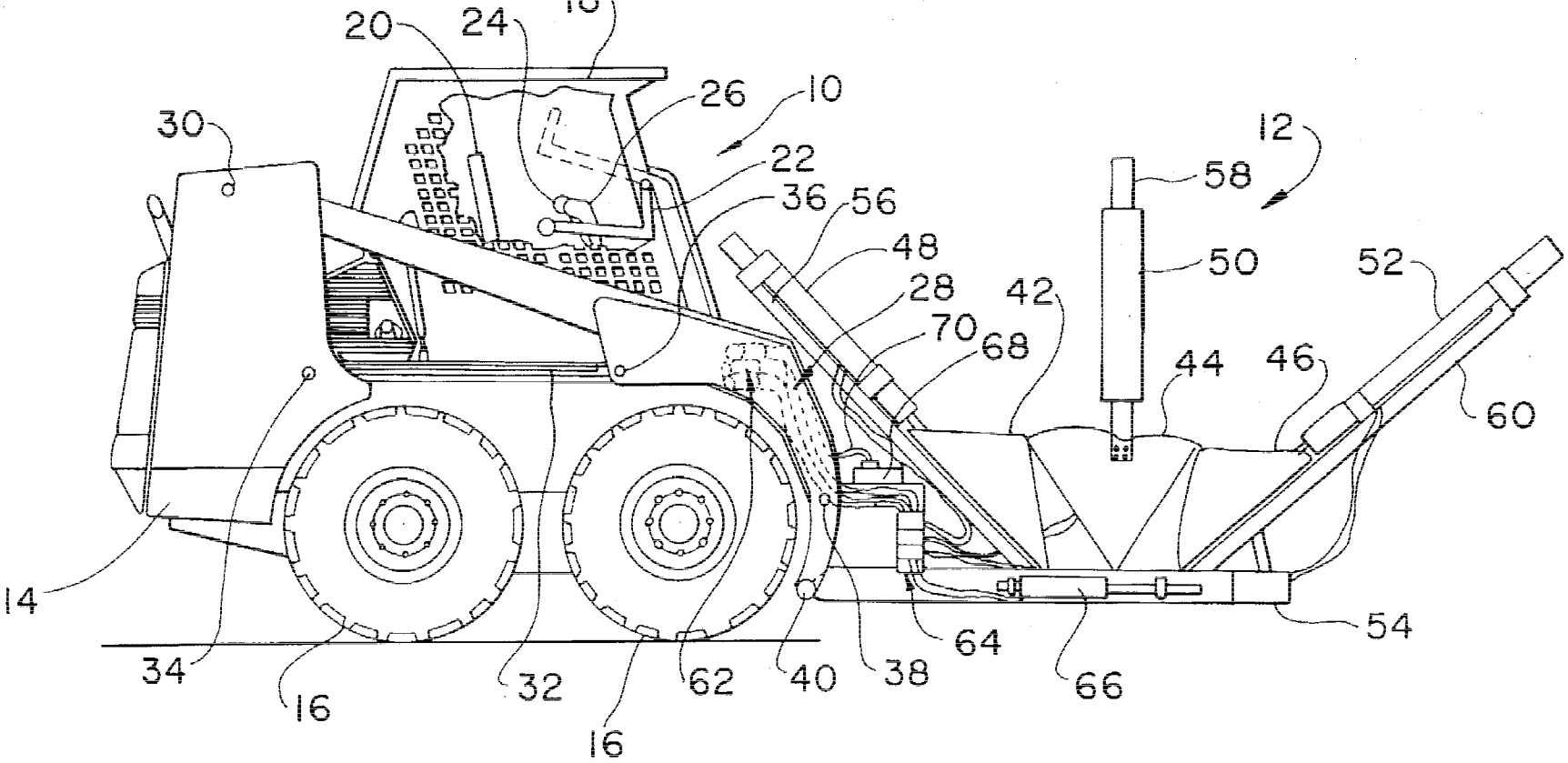
FIG. 1 is a side view of a skid steer loader with a tree spade attachment.

FIG. 1 is a side elevational view of a skid steer loader 10 having an attachment 12 according to the present invention. Skid steer loader 10 includes a frame 14 supported by wheels 16. Frame 14 also supports a cab 18 which defines an operator compartment and which substantially encloses a seat 20 on which an operator sits to control skid steer loader 10. A seat bar 22 is pivotally coupled to a front portion of cab 18. When the operator occupies seat 20, the operator then pivots seat bar 22 from the raised position (shown in phantom in FIG. 1) to a lowered position shown in FIG. 1. Cab 18 also typically includes a pair of control levers 24 and 26 with associated hand grips. Control levers 24 and 26 include actuable inputs (such as rocker switches, buttons or other operator input devices) for providing input signals.

A lift arm 28 is coupled to frame 14 at pivot points 30. A pair of hydraulic cylinders 32 (only one of which is shown in FIG. 1) are pivotally coupled to frame 14 at pivot points 34 and to lift arm 28 at pivot points 36. Lift arm 28 is coupled to tool (attachment) 12 (which in the embodiment shown in FIG. 1 is a tree spade) at points 38 and 40 or by another suitable connection.

Tree spade 12 includes, in the embodiment shown in FIG. 1, three spades 42, 44 and 46, respectively. It should be noted that any other suitable number of spades can also be used. Spades 42, 44 and 46 are coupled to hydraulic cylinders 48, 50 and 52, respectively. The hydraulic cylinders and spades are connected to a lower bracket 54 by a plurality of support brackets 56, 58 and 60. Spades 42, 44 and 46 are connected to move generally upwardly and downwardly along, and relative to, support brackets 56, 58 and 60.

Hydraulic cylinders 48, 50 and 52 are powered by the hydraulic system of skid steer loader 10 through connection 62. Connection 62 includes a pair of hydraulic fluid line connectors and an electrical connector. The hydraulic fluid line connectors in connection 62 are connected, by suitable conduits, to a plurality of electrically controllable valves collectively referred to by numeral 64. Valves 64 have inputs receiving fluid under pressure from the hydraulic system of skid steer loader 10 and have outputs connected to cylinders 48, 50 and 52. In addition, a Gate cylinder 66 (which will be described in greater detail with respect to FIG. 2) is coupled to bracket 54 and is also connected to an output of one of the plurality of valves 64.

An electric control circuit 68 is mounted on tree spade 12. Control circuit 68 is described in greater detail later in the specification and includes an electronic controller which receives electrical input signals via an electronic harness 70 (connected to the electrical connector in connection 62), from the operator inputs connected to levers 24 and 26. Based on the inputs received, control circuit 68 provides electrical outputs to electrically actuated valves 64 to control the operation of tree spade 12. Upon receiving appropriate input signals, controller 68 controls valves 64 so that the hydraulic cylinders 48, 50 and 52 (which drive spades 42, 44 and 46, respectively) extend or retract, as desired.

Figure 2:
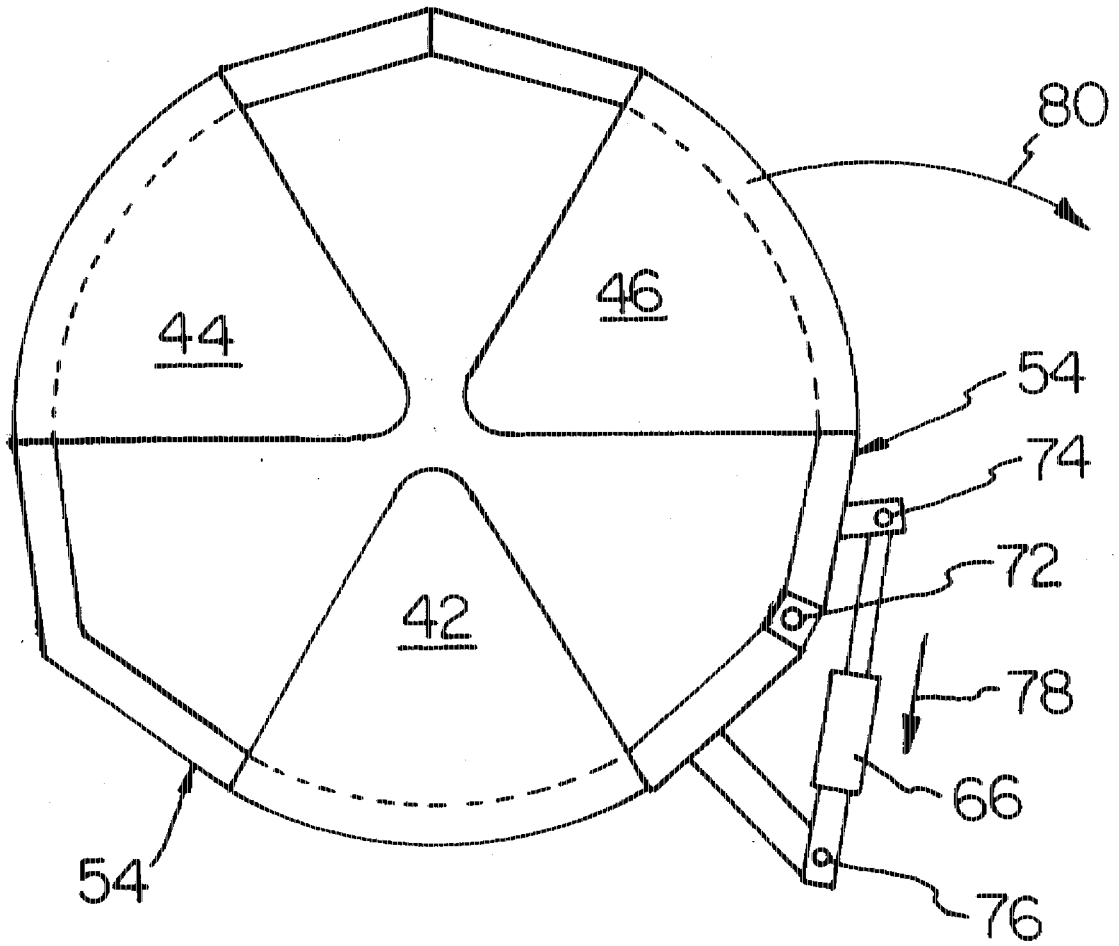
FIG. 2 is a top view of a portion of the tree spade attachment shown in FIG. 1.

FIG. 2 is a top view of a portion of a tree spade 12. When it is desired to remove a plant from the ground, the operator actuates an appropriate input at one of levers 24 and 26 and provides control circuit 68 with a gate signal. This causes control circuit 68 to control one of valves 64 to actuate hydraulic cylinder 66. This causes the portion of bracket 54 which supports spade 46 to pivot relative to the remainder of bracket 54 and to open at a distal end of bracket 54. The operator then drives forward in skid steer loader 10 such that the plant is located substantially in the middle of bracket 54.

The operator then causes control circuit 68 to control one of valves 64 to cause hydraulic cylinder 66 to extend and thereby close the gate. Tree spade 12 is then in position so that spades 42, 44 and 46 can be driven into the ground. Thus, the operator causes control circuit 68 to apply hydraulic fluid under pressure to cylinders 48, 50 and 52 to thereby drive the associated spades 42, 44 and 46 into the ground around the plant. Then, the operator causes hydraulic cylinder 32 to extend and lift bracket 54 and tree spade 12. Skid steer loader 10 can then be driven to the site where the plant contained in tree spade 12 is to be deposited onto the ground, or where it is to be loaded onto another vehicle, etc.

FIG. 2 shows that the portion of bracket 54 which supports spade 46 is pivotally connected to the remainder of bracket 54 at pivot point 72. Also, hydraulic cylinder 66 is pivotally coupled to both portions of bracket 54 at pivot points 74 and 76. Therefore, as hydraulic cylinder 66 is caused to retract such that the piston moves generally in the direction indicated by arrow 78, the portion of bracket 54 supporting spade 46 pivots relative to the remainder of bracket 54 about an arc generally indicated by arrow 80. Thus, the swinging portion of bracket 54 opens like a gate allowing the operator of skid steer loader 10 to drive forward so that the plant to be removed from the ground can be centered among spades 42, 44 and 46. When the plant is in the desired position relative to the spades, the operator causes hydraulic cylinder 66 to again extend and swing the portion of bracket 54, supporting spade 46 back into the closed position so that the spades can be operated.

Figure 3:
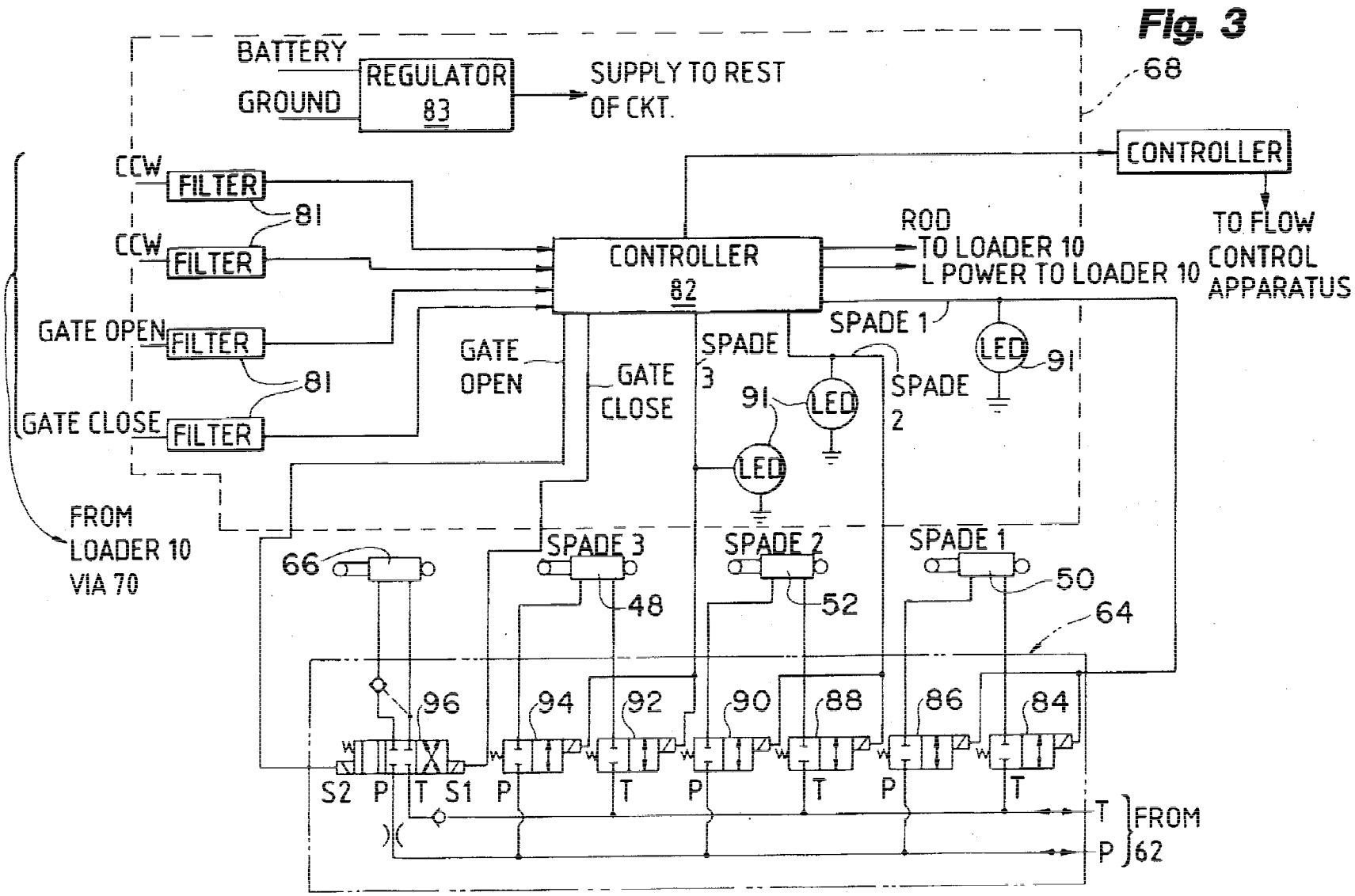
FIG. 3 is a block diagram of a control system controlling the tree spade attachment shown in FIGS. 1 and 2.

FIG. 3 is a block diagram of control circuit 68 according to the present invention. FIG. 3 also shows the connection of control circuit 68 to valves 64 and hydraulic cylinders 48, 50, 52 and 66.

The valves 64 include a pair of solenoid valves associated with each of the spade cylinders 48, 50 and 52, and an additional valve associated with gate cylinder 66. Valves 84 and 86 are associated with cylinder 50, valves 88 and 90 are associated with cylinder 52, valves 92 and 94 are associated with cylinder 48 and valve 96 is associated with cylinder 66. The inputs to the valves can be manipulated to selectively open the hydraulic circuit through the valves to apply hydraulic fluid under pressure to the selected cylinder.

Control circuit 68 also includes a power circuit 83 which receives a battery signal from the battery of skid steer loader 10, as well as a ground signal. Filtering and voltage regulation circuitry is provided so that a controlled and regulated voltage reference potential is obtained in control circuit 68 and used to power the various circuitry therein. The battery signal applied to control circuit 68 is connected to the ignition circuit of skid steer loader 10 so that the battery signal is only applied to control circuit 68 when skid steer loader 10 is running.

Control circuit 68 receives four inputs from the operator input devices on levers 24 and 26. Those inputs include a Counter Clock-wise signal, a Clock-wise signal, a Gate Open signal and a Gate Close signal. Those signals are provided through appropriate filter and conditioning circuitry 81 to controller 82. In the preferred embodiment, controller 82 is a programmable logic controller, a microprocessor, a micro-controller, or other suitable control circuit. Based on the input signals, controller 82 provides seven output signals, SPADE 1, SPADE 2, SPADE 3, GATE OPEN, GATE CLOSE, ROD and L-POWER. The function of controller 82 is described in greater detail below.

In one preferred embodiment, the inputs are provided through rocker switches which are spring loaded to a central position. For example, in the preferred embodiment, both the Clock-wise and Counter Clock-wise input signals are provided by a single rocker switch which is spring loaded to a central position. When the rocker switch is depressed in one direction, the Counter Clock-wise signal is provided to control circuit 68. When the rocker switch is depressed in a second direction, the Clock-wise signal is provided to control circuit 68. This is also the preferred embodiment for providing the Gate Open and Gate Close signals to control circuit 68.

In operation, when control circuit 68 is powered up, one of the spade output signals is energized as a default. In the preferred embodiment, the SPADE 1 output signal is energized. When the SPADE 1 signal is energized, both valves 84 and 86 receive inputs energizing the solenoids therein from moving the valves to work positions. Once one of the valves 64 is energized, movement of the associated hydraulic cylinder is accomplished through an operator input from one of levers 24 and 26, such as by a button or by rotating a handle or hand grip which causes associated movement of a valve spool in the loaders hydraulic system so that hydraulic fluid is applied to either the base or rod end of the associated hydraulic cylinder. The hand control can either move the valve spool through a mechanical linkage, or through electronic means. Also, the hydraulic fluid can either be provided to the tree spade 12 in an on/off mode, or in a proportional mode. One example of providing hydraulic fluid in a proportional mode is set out in the co-pending patent application, Ser. No. 08/435,601, filed May 5, 1995, entitled HYDRAULIC CONTROL SYSTEM PROVIDING PROPORTIONAL MOVEMENT TO AN ATTACHMENT OF A POWER MACHINE, which is hereby incorporated by reference.

In the case where valves 84 and 86 are energized, actuation of the hand grip causes hydraulic fluid under pressure to be applied to one or the other of valves 84 and 86, and the remaining of valves 84 and 86 to be connected to tank. This causes hydraulic cylinder 50 to either extend or retract (depending on whether the hydraulic fluid under pressure is provided to the base end or the rod end of cylinder 50). Therefore, cylinder 50 either drives spade 42 into the ground or removes spade 42 from the ground.

If the operator then desires to manipulate another one of spades 42, 44 or 46, the operator simply either applies the Counter Clock-wise signal or the Clock-wise signal to controller 82. If the operator applies the Counter Clock-wise signal, controller 82 activates the SPADE 2 output which energizes both of valves 88 and 90. Then, by depressing the appropriate button on one of levers 24 or 26, hydraulic fluid under pressure is applied through one valves of 88 and 90 to either the base or rod end of hydraulic actuator 52 to cause it to either extend or retract. This causes spade 46 to either be driven into the ground or withdrawn from the ground.

It can be seen that by manipulating the Clock-wise and Counter Clock-wise signals provided to controller 82, the operator can substantially choose any desired spade for manipulation. In addition, it should be noted that indicia can optionally be provided to the operator indicating which of the spade solenoids are then energized. Such indicia can include a light emitting (LED) 91 which is coupled to the output of controller 82 and positioned so that it can be seen by the operator.

The Gate Open and Gate Close hydraulic cylinder 66 is operated in a similar manner. If the operator depresses the appropriate rocker switch indicating that the operator desires the gate to be opened, the Gate Open signal is applied to controller 82 and controller 82 energizes the GATE OPEN output. This output is provided to valve 96 energizing a solenoid to cause the spool to move from the neutral position to a work position in which hydraulic fluid under pressure is applied to the rod end of hydraulic cylinder 66. This causes hydraulic cylinder 66 to retract and thereby pivot spade 46 to open the gate of tree spade 12 (as discussed with respect to FIG. 2). When the operator desires to close the gate, the operator applies the Gate Close signal to controller 82. Controller 82, in turn, provides the GATE CLOSE output to valve 96 causing the solenoid to be energized to move the spool in the opposite direction so that hydraulic fluid under pressure is provided to the base end of hydraulic cylinder 66. This causes hydraulic cylinder 66 to extend and thereby close the gate of tree spade 12 (as also discussed with respect to FIG. 2).

In some skid steer loaders 10, a diverter valve is provided in the hydraulic power circuit which diverts hydraulic fluid flow either to the front auxiliary connections, or to the rear auxiliary connections. In one preferred embodiment, skid steer loader 10 may be provided with rear stabilizers which are powered through the rear auxiliary connections. Therefore, the L-power output is provided by controller 82. This output is provided back to the hydraulic power circuit of skid steer loader 10 and is applied to the diverter valve (through energization of appropriate relays) which diverts fluid flow between the front and rear auxiliaries. In this way, certain of the functions on the tree spade 12 (such as the Gate Open and the Gate Close functions) can be powered with hydraulic fluid which would otherwise be diverted to the rear auxiliary connections.

In other words, when the Gate Open or Gate Close input is activated, the L-power output causes the diverter valve to divert flow to the front auxiliary connections to provide hydraulic fluid under pressure to hydraulic cylinder 66. However, when neither the Gate Open nor Gate Close input is energized, controller 82 provides the L-power output in the de-energized state so that the diverter valve on the skid steer loader 10 diverts fluid to the rear auxiliary connections so that the rear stabilizers can be manipulated by the operator.

The ROD output from controller 82 is provided for a similar reason. The same operator input device on one of levers 24 or 26 which is used to cycle the energized spade output, either Clock-wise or Counter Clock-wise, can also be used to manipulate the rear stabilizers. Therefore, the output signal is provided so that hydraulic fluid under pressure is provided to both sides of a directional control valve that controls the rear auxiliaries so that movement does not occur in the stabilizers when the operator only wishes to cycle the energized spade output.

It should also be noted that controller 82 can be coupled for communication with a controller, such as 83, which resides on the skid steer loader 10. In one preferred embodiment, controller 83 is an on/off controller which controls hydraulic fluid flow to the attachment. In another embodiment, controller 83 is a proportional controller such as that described in U.S. application Ser. No. 08/435,601 incorporated herein by reference. Briefly, the proportional controller controls flow of hydraulic fluid to the attachment in a pulse-width-modulated, or other proportional manner.

Figures 4, 4A:
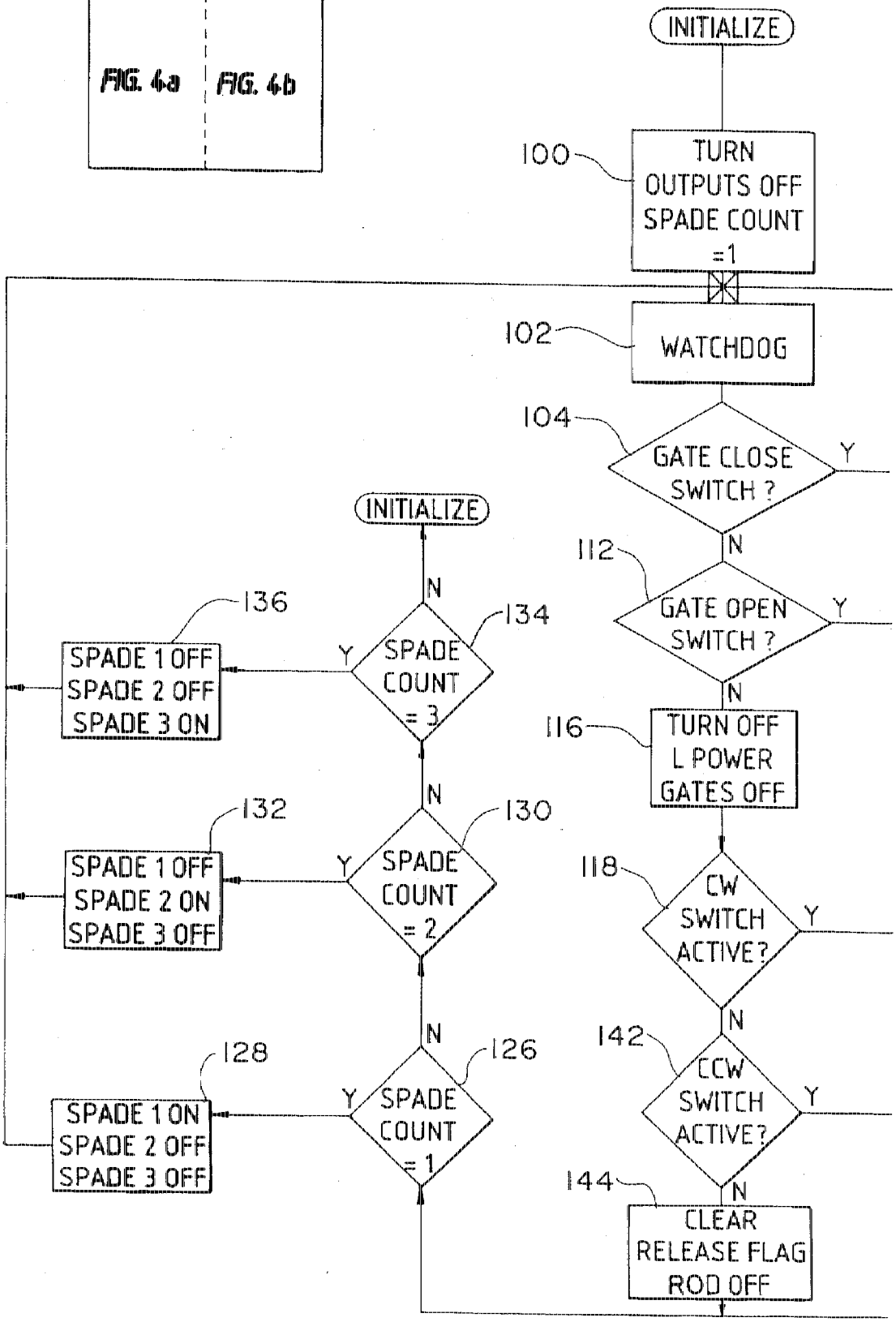
FIG. 4 is a flow chart illustrating operation of the tree spade attachment shown in FIGS. 1 and 2.
Figure 4B:
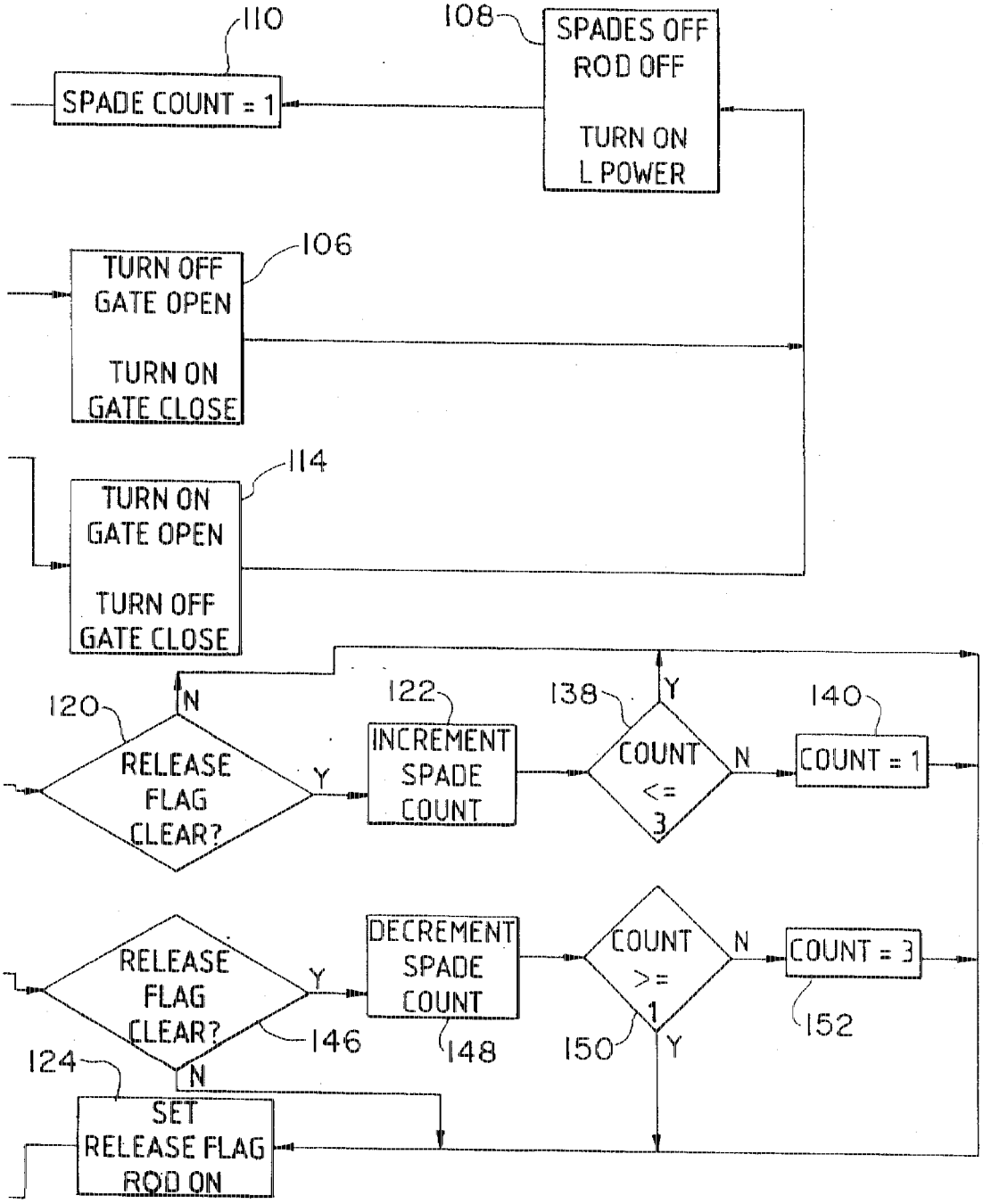

FIG. 4 is a flow diagram of the operation of control circuit 68 according to the present invention. Initially, when control circuit 68 is powered up, all of the outputs are turned off and a variable referred to as Spade Count is set to 1. This is indicated by block 100. A watch dog timer set with any suitable recycle time is implemented. Controller 82 waits for the time out period for the watch dog timer to lapse. This is indicated by block 102.

When operation commences, controller 82 determines whether the Gate Close signal has been applied. This is indicated by block 104. If so, controller 82 turns off the GATE OPEN output (if it was on) and turns on or energizes, the GATE CLOSE output. This is indicated by block 106. Then, controller 82 assures that all of the SPADE output signals are turned off, that the ROD output signal is turned off, and that the L-POWER output is turned on. This is indicated by block 108. The spade count variable is set to 1 (if it is not already 1) and control returns to block 102. This is indicated by block 110.

If, at block 104, the Gate Close input signal has not been applied, controller 82 determines whether the Gate Open signal has been applied. This is indicated by block 112. If so, controller 82 turns on the GATE OPEN output and turns off the GATE CLOSE output. This is indicated by block 114. Then, processing continues through blocks 108 and 110.

If, at block 112, controller 82 determines that the Gate Open signal has not been applied, controller 82 turns off the L-POWER output, as well as the GATE OPEN and GATE CLOSE outputs. This is indicated by block 116.

Controller 82 then determines whether the Clock-wise switch has been activated. This is indicated by block 118. If so, a variable referred to as release flag is examined by controller 82. If the release flag variable is clear, the spade count is incremented. This is indicated by blocks 120 and 122. However, if the release flag is not clear, the release flag is set, the ROD output is turned on, and the controller 82 energizes the appropriate spade output signal based on the spade count. This is indicated by blocks 124, 126, 128, 130, 132, 134 and 136.

If, after the spade count has been incremented, the count is less than or equal to three, then it is a valid count and proceeds according to blocks 124, 126, 128, 130, 132, 134 and 136. However, if at block 122, the spade count has been incremented so that is greater than 3, then the count is set to 1 and processing continues with respect to blocks 124, 126, 128, 130, 132, 134 and 136. This sequence is indicated by blocks 138 and 140.

If, at block 118, controller 82 determines that the Clockwise input is not active, controller 82 determines whether the Counter Clock-wise input is active. This is indicated at block 142. If not, the variable release flag is cleared, the ROD output is turned off, and processing continues with respect to blocks 126, 128, 130, 132, 134 and 136. This is indicated by block 144.

However, if the Counter Clock-wise input is activated in block 142, then controller 82 proceeds substantially in the same fashion as indicated with respect to blocks 120, 122, 138 and 140. The difference is that if the release flag is clear, the spade count is decremented. Also, if, after being decremented, the spade count is less than 1, then the spade count is set to 3. This is indicated by blocks 146, 148, 150 and 152.

It should also be noted that some skid steer loaders are provided with an interlock control system such as that set out in U.S. Pat. No. 5,425,431 issued on Jun. 20, 1995, to Brandt et al. Such systems provide certain interlocks which lock out certain functions based on inputs from various sensors. Therefore, additional inputs can be provided to controller 82 indicating the state of the outputs from such an interlock control system. Based on these inputs, controller 82 connects accordingly to shut off hydraulic flow to any desired actuators.

By providing a microprocessor on the attachment according to the present invention, the rear or front auxiliaries can be used for both the attachment and the rear stabilizers in a working situation. The attachment controller 82 provides signals and communicates with the loader controllers to facilitate this function. Further, with the implementation of a microprocessor or other suitable controller on the attachment itself, numerous functions on the attachment can be controlled with minimum electrical signals being provided to the controller. This provides the ability to add additional control functions on the attachment without increasing the cost of the skid steer loader, by simply putting appropriate logic and control features into control circuit 68. Also, by providing an electronic controller on the attachment, the controller of the attachment can be interfaced with, and connected to, any other microprocessors which are utilized in controlling the skid steer loader 10.

Although the present invention has been described with reference to preferred embodiments, workers skilled in the art will recognize that changes may be made in form and detail without departing from the spirit and scope of the invention.

What is claimed is:

1. An attachment attachable to a power machine having a hydraulic system providing hydraulic fluid under pressure, and having an operator input device receiving an operator input and providing an output signal indicative of the operator input, the attachment comprising:

a support structure;

a tool mounted to the support structure;

a first hydraulic actuator, coupled to the tool to drive the tool and connectable to the hydraulic system of the power machine; and a controller, mounted to the support structure, operably coupled to the first hydraulic actuator, and operably coupleable to the operator input device when the attachment is attached in the power machine, to control operation of the tool based on the operator input.

2. The attachment of claim 1 wherein one of the power machine and the attachment include a valve coupled between the hydraulic system of the power machine and the actuator to control flow of the hydraulic fluid to the actuator and wherein the controller is operably coupled to the actuator by being coupled to the valve to control the valve.

3. The attachment of claim 2 wherein the valve is mounted on the attachment.

4. The attachment of claim 3 wherein the tool comprises a plurality of spades, one of the spades being a pivotal spade pivotally mounted relative to an adjacent spade.

5. The attachment of claim 4 and further comprising a plurality of hydraulic actuators, one hydraulic actuator being coupled to each of the plurality of spades.

6. The attachment of claim 5 and further comprising:

a plurality of valves one of the plurality of valves being coupled between the hydraulic system of the power machine and each of the plurality of hydraulic actuators to control flow of the hydraulic fluid to the actuators and wherein the controller is operably coupled to each of the plurality of hydraulic actuators by being coupled to the plurality of valves to control the valves.

7. The attachment of claim 5 and further comprising:

a gate actuator, coupled to the pivotal spade to pivot the pivotal spade relative to the adjacent spade.

8. The attachment of claim 7 and further comprising:

a gate valve coupled between the hydraulic system of the power machine and the gate actuator to control flow of the hydraulic fluid to the gate actuator and wherein the controller is operably coupled to the gate actuator by being coupled to the valve to control the valve.

9. An attachment for a power machine, the power machine having a power circuit, the attachment comprising:

a tool;

a first power actuator coupled to the tool to drive the tool, and couplable to the power circuit to receive power from the power circuit; and a controller, mounted on the attachment and operably coupled to the power actuator to control the power actuator.

10. The attachment of claim 9 wherein the power machine includes an operator input device for receiving an operator input and providing an operator input signal based on the operator input, and wherein the controller is operably couplable to the operator input device to receive the operator input signal, the controller controlling the tool based on the operator input signal.

11. The attachment of claim 10 wherein the controller provides a control signal to the power machine to control at least a portion of the operation of the power machine.

12. The attachment of claim 11 wherein the control signal controls a portion of the power circuit in the power machine.

13. The attachment of claim 12 wherein the power circuit comprises a hydraulic power system and wherein the control signal controls flow of hydraulic fluid through a portion of the hydraulic system.

14. The attachment of claim 10 wherein the power machine includes at least one of an on/off controller and a proportional controller and wherein the controller on the attachment includes means for communication with the proportional controller.

15. The attachment of claim 14 wherein the one of the on/off and proportional controllers controls flow of hydraulic fluid to the attachment.

16. The attachment of claim 9 wherein the controller comprises:

a microprocessor-based electronic controller.

17. A power machine, comprising:

a power system;

a plurality of machine power actuators coupled to the power system;

a first controller receiving a plurality of inputs and controlling at least one function of the power machine based on the inputs;

an operator input device providing an input signal in response to operator inputs; and an attachment coupled to the power machine, the attachment comprising:

a tool;

an attachment power actuator connected to the power system and to the tool; and a second controller mounted on the attachment, operably coupled to the operator input device to receive the input signal, and operably coupled to the power actuator to control the power actuator based on the input signal.

18. The power machine of claim 17 wherein the first and second controllers are coupled to communicate with one another.

19. The power machine of claim 17 wherein the first controller controls a portion of the power system and wherein the second controller provides a control signal controlling at least one function on the power machine.

20. The power machine of claim 19 wherein the control signal provided by the second controller controls a portion of the power system.

21. The power machine of claim 18 wherein the first controller is configured to receive parameter signals from the second controller indicative of operating parameters at the attachment, and to control the power machine based on the parameter signals.

* * * * *